US007267700B2

(12) United States Patent
Collins et al.

(10) Patent No.: US 7,267,700 B2
(45) **Date of Patent: *Sep. 11, 2007**

(54) STRUCTURED ABRASIVE WITH PARABOLIC SIDES

(75) Inventors: Stanley B. Collins, White Bear Lake, MN (US); John D. Haas, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/668,736

(22) Filed: Sep. 23, 2003

(65) Prior Publication Data

US 2005/0060946 A1 Mar. 24, 2005

(51) Int. Cl.
*B24D 3/00* (2006.01)

(52) U.S. Cl. ..... 51/298; 51/295; 51/307; 51/308; 51/309

(58) Field of Classification Search ..... 51/298, 51/295, 307, 308, 309; 451/28
See application file for complete search history.

(56) References Cited

U.S. PATENT DOCUMENTS

| | | | |
|---|---|---|---|
| 3,594,865 | A | 7/1971 | Erb |
| 3,898,772 | A | 8/1975 | Sawluk |
| 4,311,489 | A | 1/1982 | Kressner |
| 4,314,827 | A | 2/1982 | Leitheiser et al. |
| 4,518,397 | A | 5/1985 | Leitheiser et al. |
| 4,623,364 | A | 11/1986 | Cottringer et al. |
| 4,644,703 | A | 2/1987 | Kaczmarek et al. |
| 4,652,274 | A | 3/1987 | Boettcher et al. |
| 4,652,275 | A | 3/1987 | Bloecher et al. |
| 4,735,632 | A | 4/1988 | Oxman et al. |
| 4,751,138 | A | 6/1988 | Tumey et al. |
| 4,773,920 | A | 9/1988 | Chasman et al. |
| 4,799,939 | A | 1/1989 | Bloecher et al. |
| 4,881,951 | A | 11/1989 | Wood et al. |
| 4,903,440 | A | 2/1990 | Larson et al. |
| 4,959,265 | A | 9/1990 | Wood et al. |
| 4,964,883 | A | 10/1990 | Morris et al. |
| 4,985,340 | A | 1/1991 | Palazzotto et al. |
| 5,014,468 | A | 5/1991 | Ravipati et al. |
| 5,015,266 | A | 5/1991 | Yamamoto |
| 5,039,311 | A | 8/1991 | Bloecher |
| 5,061,294 | A | 10/1991 | Harmer et al. |
| 5,077,870 | A | 1/1992 | Melbye et al. |

(Continued)

FOREIGN PATENT DOCUMENTS

DE 293 300 A5 8/1991

(Continued)

OTHER PUBLICATIONS

ANSI B74, 18-1996 "For Grading of Certain Abrasive Grain on coated Abrasive Material" , no month.

(Continued)

*Primary Examiner*—Michael Marcheschi

(57) ABSTRACT

An abrasive article and methods of making and using the same are disclosed. The abrasive article includes a plurality of features on a backing. The features have a base and a body. The body is defined by sidewalls having parabolic sections. In some embodiments, the sidewalls are defined by a series of inner-connected lines segments approximating a parabolic section.

3 Claims, 8 Drawing Sheets

U.S. PATENT DOCUMENTS

| | | | | |
|---|---|---|---|---|
| 5,137,542 | A | 8/1992 | Buchanan et al. | |
| 5,152,917 | A | 10/1992 | Pieper et al. | |
| 5,201,101 | A | 4/1993 | Rouser et al. | |
| 5,201,916 | A | 4/1993 | Berg et al. | |
| 5,203,884 | A | 4/1993 | Buchanan et al. | |
| 5,236,472 | A | 8/1993 | Kirk et al. | |
| 5,304,223 | A | 4/1994 | Pieper et al. | |
| 5,312,789 | A | 5/1994 | Wood | |
| 5,316,812 | A | 5/1994 | Stout et al. | |
| 5,378,251 | A | 1/1995 | Culler et al. | |
| 5,435,816 | A | 7/1995 | Spurgeon et al. | |
| 5,484,330 | A | 1/1996 | Flood et al. | |
| 5,489,235 | A | 2/1996 | Gagliardi et al. | |
| 5,578,099 | A | 11/1996 | Neff | |
| 5,611,829 | A | 3/1997 | Monroe et al. | |
| 5,672,097 | A | 9/1997 | Hoopman | |
| 5,681,217 | A * | 10/1997 | Hoopman et al. | 451/528 |
| 5,833,724 | A | 11/1998 | Wei et al. | |
| 5,855,632 | A | 1/1999 | Stoetzel et al. | |
| 5,863,306 | A | 1/1999 | Wei et al. | |
| 5,891,204 | A | 4/1999 | Neff | |
| 6,076,248 | A * | 6/2000 | Hoopman et al. | 29/527.1 |
| 6,120,568 | A | 9/2000 | Neff | |
| 6,129,540 | A | 10/2000 | Hoopman et al. | |
| 6,194,317 | B1 | 2/2001 | Kaisaki et al. | |
| 6,224,465 | B1 | 5/2001 | Meyer | |
| 6,319,108 | B1 | 11/2001 | Adefris et al. | |
| 6,371,842 | B1 | 4/2002 | Romero | |
| 6,761,620 | B2 | 7/2004 | Naujok | |
| 6,817,936 | B1 | 11/2004 | Skeem et al. | |
| 6,821,196 | B2 | 11/2004 | Oliver | |
| 2001/0008830 | A1 | 7/2001 | Tolles et al. | |

FOREIGN PATENT DOCUMENTS

| | | | |
|---|---|---|---|
| EP | 0 109 581 | A2 | 5/1984 |
| EP | 0 306 161 | A2 | 3/1989 |
| EP | 0 306 162 | A2 | 3/1989 |
| EP | 0 938 950 | A2 | 9/1999 |
| FR | 881239 | | 4/1943 |
| WO | 93/12911 | A1 | 7/1993 |
| WO | WO99/43491 | | 9/1999 |
| WO | WO 01/04227 | A2 | 1/2001 |
| WO | WO 01/45903 | A1 | 6/2001 |
| WO | WO 02/14018 | A2 | 2/2002 |

OTHER PUBLICATIONS

U.S. Application entitled "A coated Abrasive Belt With an Endless, Seamless Backing and Method of Preparation," Benedict et al., filed Jul. 24, 1992, having U.S. Appl. No. 07/919541.

U.S. Application entitled "A Method of Making an Abrasive Article," Spurgeon et al., filed Jan. 14, 1993, having U.S. Appl. No. 08/004929.

U.S. Application entitled "Abrasive Article for Finishing," Hoopman et al., filed Sep. 13, 1993, having U.S. Appl. No. 08/120300.

* cited by examiner

STRUCTURED ABRASIVE WITH PARABOLIC SIDES

FIELD

This disclosure is directed to an abrasive article, particularly a structured abrasive article, methods of making, and methods of using.

BACKGROUND

Abrasive articles have been utilized to abrade and finish workpiece surfaces for well over a hundred years. These applications have ranged from high stock removal, high pressure metal grinding processes to fine polishing, such as of ophthalmic lenses. In general, abrasive articles are made of a plurality of abrasive particles bonded either together (e.g., a bonded abrasive or grinding wheel) or to a backing (e.g., a coated abrasive). For a coated abrasive there is typically a single layer, or sometimes two layers, of abrasive particles. Once these abrasive particles are worn, the coated abrasive is essentially worn out and is typically discarded.

A more recent development in three-dimensional coatings of abrasive particles has provided abrasive articles often referred to as "structured abrasives". Various constructions of structured abrasive articles are disclosed, for example, in U.S. Pat. No. 5,152,917 (Pieper et al.), which is herein incorporated by reference. Pieper teaches a structured abrasive that results in a relatively high rate of cut and a relatively fine surface finish on the workpiece surface. The structured abrasive comprises non-random, precisely shaped abrasive composites that are bonded to a backing.

Other references directed to structured abrasive articles and methods of making them include U.S. Pat. No. 5,855,632 (Stoetzel et al.), U.S. Pat. No. 5,681,217 (Hoopman et al.), U.S. Pat. No. 5,435,816 (Spurgeon et al.), U.S. Pat. No. 5,378,251 (Culler et al.), U.S. Pat. No. 5,304,223 (Pieper et al.), and U.S. Pat. No. 5,014,468 (Ravipati et al.), all of which are herein incorporated by reference.

Pieper, and the other structured abrasive patents, are a significant advancement in the abrasives art, however there is always room for improvement.

SUMMARY

One aspect of the present disclosure is directed to a feature for an abrasive article. The feature includes a base and a body. The body is defined by sidewalls having parabolic cross-sections. In one embodiment, the body includes four sidewalls. In another embodiment, the four sidewalls are symmetric parabolic sections.

Another aspect of the present disclosure is directed to an abrasive article having an array of features on a backing. The array includes a plurality of features each including a base and a body. Each body is body is defined by sidewalls having parabolic cross-sections. In one embodiment, the body includes four sidewalls. In another embodiment, the four sidewalls are symmetric parabolic sections.

DETAILED DESCRIPTION

This invention pertains to an abrasive array, an abrasive article, a method of making an abrasive article and a method of using an abrasive article.

Figure 1:
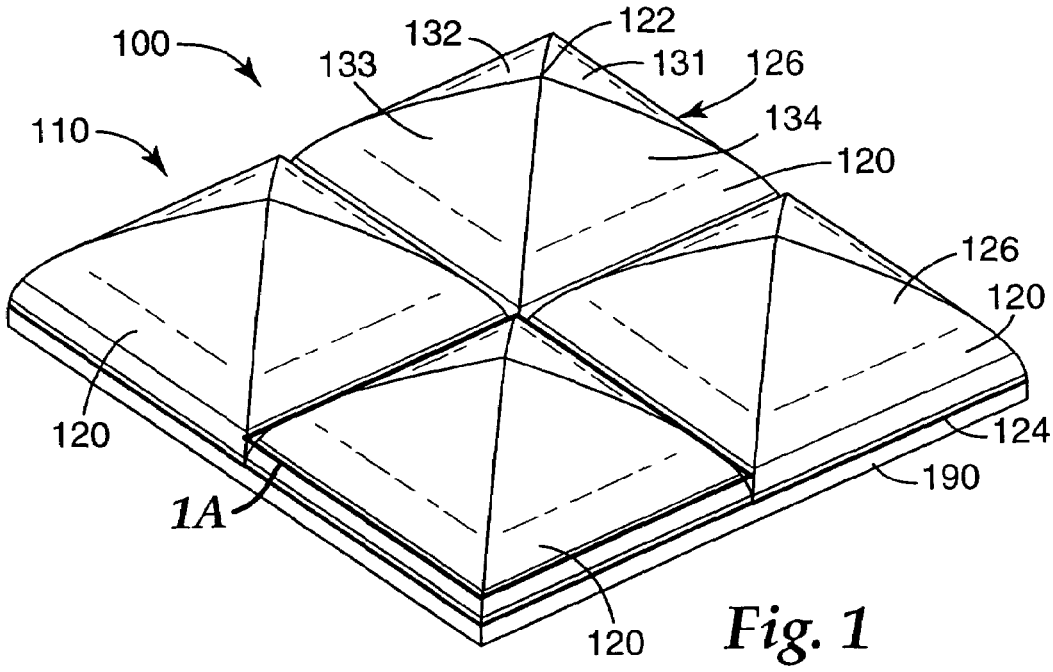
FIG. 1 is a perspective view of a section of an example embodiment of an abrasive article according to the present disclosure.
Figure 1A:
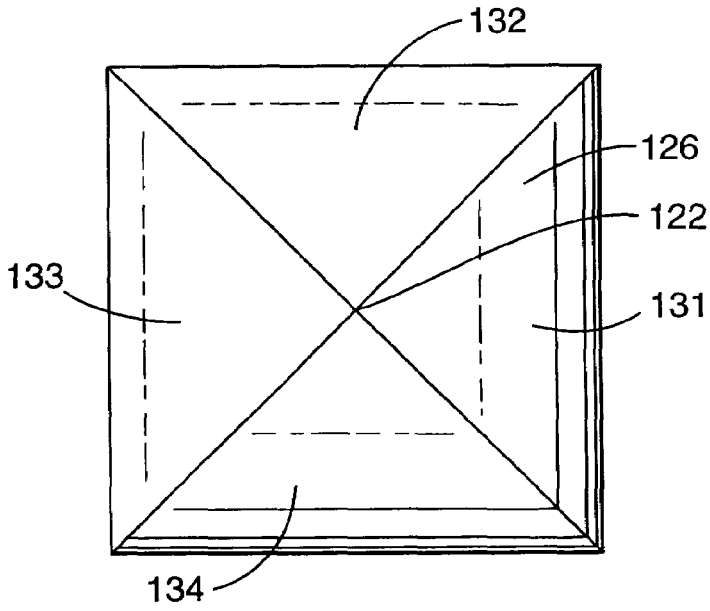
FIG. 1A is a plan view of a feature of the article of FIG. 1.

Referring to FIG. 1, the abrasive article 100 comprises abrasive composites 120. In the context of this disclosure, the term "composites" is used interchangeably with the term "features". The abrasive composites are bonded to a surface of a backing 190. The boundary or boundaries associated with the composite shape result in one abrasive composite being separated to some degree from another adjacent abrasive composite. To form an individual abrasive composite, a portion of the boundaries forming the shape of the abrasive composite must be separated from one another. In some embodiments, the base or a portion of the abrasive composite closest to the backing can abut with its neighboring abrasive composite. Abrasive composites 120 comprise a plurality of abrasive particles that are dispersed in a binder and a grinding aid. It is also within the scope of this invention to have a combination of abrasive composites bonded to a backing in which some of the abrasive composites abut, while other abrasive composites have open spaces between them.

Backing

The backing of this invention has a front and back surface and can be any conventional abrasive backing. Examples of useful backings include polymeric film, primed polymeric film, cloth, paper, vulcanized fiber, nonwovens, and combinations thereof. Other useful backings include a fibrous reinforced thermoplastic backing as disclosed in U.S. Pat. No. 5,316,812 and an endless seamless backing as disclosed in World Patent Application No. WO 93/12911 published. Both of which are hereinafter incorporated by reference. The backing may also contain a treatment or treatments to seal the backing and/or modify some physical properties of the backing. These treatments are well known in the art.

The backing may also have an attachment means on its back surface to enable securing the resulting coated abrasive to a support pad or back-up pad. This attachment means can be a pressure sensitive adhesive, one surface of a hook and loop attachment system, or a threaded projection as disclosed in the above-mentioned U.S. Pat. No. 5,316,812.

Alternatively, there may be an intermeshing attachment system as described in the assignee's U.S. Pat. No. 5,201,101, incorporated herein after by reference.

The back side of the abrasive article may also contain a slip resistant or frictional coating. Examples of such coatings include an inorganic particulate (e.g., calcium carbonate or quartz) dispersed in an adhesive.

Abrasive Coating

Abrasive Particles

The abrasive particles typically have a particle size ranging from about 0.1 to 1500 micrometers, usually between about 0.1 to 400 micrometers, preferably between 0.1 to 100 micrometers and most preferably between 0.1 to 50 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide and white aluminum oxide), ceramic aluminum oxide, green silicon carbide, silicon carbide, chromia, alumina zirconia, diamond, iron oxide, ceria, cubic boron nitride, boron carbide, garnet and combinations thereof.

The term "abrasive particle" also encompasses when single abrasive particles are bonded together to form an abrasive agglomerate. Abrasive agglomerates are further described in U.S. Pat. Nos. 4,311,489; 4,652,275 and 4,799,939, all of which are incorporated herein by reference.

It is also within the scope of this invention to have a surface coating on the abrasive particles. The surface coating may have many different functions. In some instances the surface coatings increase adhesion of abrasive particles to the binder, alter the abrading characteristics of the abrasive particle, and the like. Examples of surface coatings include coupling agents, halide salts, metal oxides including silica, refractory metal nitrides, refractory metal carbides and the like.

In the abrasive composite there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

Binder

The abrasive particles are dispersed in an organic binder to form the abrasive composite. The binder is derived from a binder precursor which comprises an organic polymerizable resin. During the manufacture of the inventive abrasive articles, the binder precursor is exposed to an energy source which aids in the initiation of the polymerization or curing process. Examples of energy sources include thermal energy and radiation energy, the latter including electron beam, ultraviolet light, and visible light. During this polymerization process, the resin is polymerized and the binder precursor is converted into a solidified binder. Upon solidification of the binder precursor, the abrasive coating is formed. The binder in the abrasive coating is also generally responsible for adhering the abrasive coating to the backing.

There are two preferred classes of resins for use in the present invention, condensation curable and addition polymerizable resins. The preferred binder precursors comprise additional polymerizable resins because these resins are readily cured by exposure to radiation energy. Addition polymerizable resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical and preferred organic resins include phenolic resins, urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and mixtures and combinations thereof. The term "acrylate" encompasses acrylates and methacrylates.

Phenolic resins are widely used in abrasive article binders because of their thermal properties, availability, and cost. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the tradenames "Durez" and "Varcum" from Occidental Chemicals Corp.; "Resinox" from Monsanto; "Aerofene" from Ashland Chemical Co. and "Aerotap" from Ashland Chemical Co.

Acrylated urethanes are diacrylate esters of hydroxy-terminated, isocyanate NCO extended polyesters or polyethers. Examples of commercially available acrylated urethanes include those known under the trade designations "UVITHANE 782", available from Morton Thiokol Chemical, and "CMD 6600", "CMD 8400", and "CMD 8805", available from Radcure Specialties.

Acrylated epoxies are diacrylate esters of epoxy resins, such as the diacrylate esters of bisphenol A epoxy resin. Examples of commercially available acrylated epoxies include those known under the trade designations "CMD 3500", "CMD 3600", and "CMD 3700", available from Radcure Specialities.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups.

Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladkipamide. Still other nitrogen containing compounds include tris (2-acryloyloxyethyl)isocyanurate, 1,3,5-tri(2-methyacryloxyethyl)-triazine, acrylamide, methylacrylamide, N-methylacrylamide, N,N-dimethylacrylamide, N-vinylpyrrolidone, and N-vinylpiperidone.

The aminoplast resins have at least one pendant alpha, betaunsaturated carbonyl group per molecule or oligomer.

These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472, both incorporated herein by reference.

Isocyanurate derivatives having at least one pendant acrylate group and isocyanate derivatives having at least one pendant acrylate group are further described in U.S. Pat. No. 4,652,274, incorporated herein after by reference. The preferred isocyanurate material is a triacrylate of tris(hydroxy ethyl) isocyanurate.

Epoxy resins have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)-phenyl propane] (diglycidyl ether of bisphenol) and commercially available materials under the trade designations "Epon 828", "Epon 1004", and "Epon 1001F" available from Shell Chemical Co., "DER-331", "DER-332", and "DER-334" available from Dow Chemical Co. Other suitable epoxy resins include glycidyl ethers of phenol formaldehyde novolac (e.g., "DEN-431" and "DEN-428" available from Dow chemical Co.).

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other cationic curing agents include a salt having an organometallic complex cation and a halogen containing complex anion of a metal or metalloid which are further described in U.S. Pat. No. 4,751,138, incorporated herein by reference (column 6, line 65 to column 9, line 45). Another example is an organometallic salt and an onium salt is described in U.S. Pat. No. 4,985,340 (column 4, line 65 to column 14, line 50); and European Patent Application Nos. 306,161 and 306,162, both published Mar. 8, 1989, all incorporated by reference. Still other cationic curing agents include an ionic salt of an organometallic complex in which the metal is selected from the elements of Periodic Group IVB, VB, VIIB, VIIB and VIIIB which is described in European Patent Application No. 109,581, published Nov. 21, 1983, incorporated by reference.

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimdazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632, entitled Coated Abrasive Binder Containing Ternary Photoinitiator System, incorporated herein by reference. The preferred initiator for use with visible light is "Irgacure 369" commercially available from Ciba Geigy Corporation.

Grinding Aid

A grinding aid is defined as a material, preferably a particulate material, the addition of which to an abrasive article has a significant effect on the chemical and physical processes of abrading which results in improved performance. Typically and preferably the grinding aid is added to the slurry as a particulate, however it may be added to the slurry as a liquid. The presence of the grinding aid will increase the grinding efficiency or cut rate (defined as weight of work piece removed per weight of abrasive article lost) of the corresponding abrasive article in comparison to an abrasive article that does not contain a grinding aid. In particular, it is believed in the art that the grinding aid will either 1) decrease the friction between the abrasive grains and the workpiece being abraded, 2) prevent the abrasive grain from "capping", i.e., prevent metal particles (in the case of a metal workpiece) from becoming welded to the tops of the abrasive grains, 3) decrease the interface temperature between the abrasive grains the workpiece, 4) decreases the grinding force required, or 5) prevents oxidation of the metal workpiece. In general, the addition of a grinding aid increases the useful life of the abrasive article.

Grinding aids useful in the invention encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphtalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron titanium, other miscellaneous grinding aids include sulfur, organic sulfur compounds, graphite and metallic sulfides. It is also within the scope of this invention to use a combination of different grinding aids and in some instances this may produce a synergistic effect.

The above-mentioned examples of grinding aids are meant to be representative only. A preferred grinding aid for use in the invention is cryolite, and the most preferred is potassium tetrafluoroborate (KBF.sub.4).

The grinding aid is considered to be non-abrasive, that is, the Moh hardness of the grinding aid is less than 8. The grinding aid may also contain impurities; these impurities should not significantly adversely affect performance of the abrasive article.

The grinding aid particle size preferably ranges from about 0.1 to 100 micrometers, more preferably between 10 to 70 micrometers. In general the particle size of the grinding aid is preferably equal to or less than the size of the abrasive particles.

The abrasive coating comprises generally at least about 1% by weight, typically at least about 2.5% by weight, preferably at least about 5% by weight, more preferably at least about 10% by weight grinding aid and most preferably at least about 20% by weight grinding aid. More than about 50 weight % grinding aid may be detrimental since it is theorized that grinding performance would decrease (since there are less abrasive particles present). It was surprising that as the amount of grinding aid was increased, the relative grinding performance as measured by cut rate is also increased. This was unexpected since as the amount of grinding aid in the abrasive coating is increased, the relative amount of abrasive particles is decreased. The abrasive particles are responsible for cutting the workpiece surface, not the grinding aid. In general, the abrasive coating comprises from 5 to 90% by weight, preferably from 20 to 80% by weight abrasive particles, from 5 to 80% by weight, preferably from 5 to 40% by weight binder, and from 5 to 60% by weight, preferably from 10 to 40% by weight grinding aid.

Optional Additives

Slurries useful in the invention may further comprise optional additives, such as, for example, fillers, fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

Examples of antistatic agents useful in the invention include graphite, carbon black, vanadium oxide, humectants, and the like. These antistatic agents are disclosed in U.S. Pat. Nos. 5,061,294; 5,137,542, and 5,203,884 incorporated herein after by reference.

A coupling agent can provide an association bridge between the binder precursor and the filler particles or abrasive particles. Examples of useful coupling agents include silanes, titanates, and zircoaluminates. Useful slurries preferably contain from about 0.01 to 3% by weight coupling agent.

An example of a suspending agent useful in the invention is an amorphous silica particle having a surface area less than 150 meters square/gram that is commercially available from DeGussa Corp., under the trade name "OX-50".

Abrasive Coating Comprising Abrasive Composites

In one preferred aspect of the invention, the abrasive coating is in the form of a plurality of abrasive composites bonded to the backing. It is generally preferred that each abrasive composites have a precise shape. The precise shape of each composite is determined by distinct and discernible boundaries. These distinct and discernible boundaries are readily visible and clear when a cross section of the abrasive article is examined under a microscope such as a scanning electron microscope. In comparison, in an abrasive coating comprising composites that do not have precise shapes, the boundaries are not definitive and may be illegible. These distinct and discernible boundaries form the outline or contour of the precise shape. These boundaries separate to some degree one abrasive composite from another and also distinguish one abrasive composite from another.

Referring to FIG. 1, the abrasive article 100 comprises abrasive composites 120. The boundary or boundaries associated with the composite shape result in one abrasive composite being separated to some degree from another adjacent abrasive composite. To form an individual abrasive composite, a portion of the boundaries forming the shape of the abrasive composite must be separated from one another. In some embodiments, the base or a portion of the abrasive composite closest to the backing can abut with its neighboring abrasive composite. Abrasive composites 120 comprise a plurality of abrasive particles that are dispersed in a binder and a grinding aid. It is also within the scope of this invention to have a combination of abrasive composites bonded to a backing in which some of the abrasive composites abut, while other abrasive composites have open spaces between them.

In some instances the boundaries forming the shape are planar. For shapes that have planes, there are at least three planes. The number of planes for a given shape can vary depending upon the desired geometry, for instance the number of planes can range from three to over 20. Generally, there are between three to ten planes, preferably between three to six planes. These planes intersect to form the desired shape and the angles at which these planes intersect will determine the shape dimensions.

In another aspect of this invention, a portion of the abrasive composites have a neighboring abrasive composite of a different dimension. In this aspect of the invention, at least 10%, preferably at least 30%, more preferably at least 50% and most preferably at least 60% of the abrasive composites have an adjacent abrasive composite that has a different dimension. These different dimensions can pertain to the abrasive composite shape, angle between planar boundaries or dimensions of the abrasive composite. The result of these different dimensions for neighboring abrasive composites results in an abrasive article that produces a relatively finer surface finish on the workpiece being abraded or refined. This aspect of the invention is further described in the assignee's co-pending patent application U.S. Pat. No. 6,076,248 (Hoopman et al.).

The abrasive composite shape can be any shape, but it is preferably a geometric shape such as a rectangle, cone, semicircle, circle, triangle, square, hexagon, pyramid, octagon and the like. Embodiments of preferred shapes are presented below in a section entitled "GEOMETRIES." An individual abrasive composite shape may be referred to herein as "protruding unit." The preferred shape is a pyramid and the base of this pyramid can be a three or four sided. It is also preferred that the abrasive composite cross sectional surface area decreases away from the backing or decreases along its height. This variable surface area results in a non-uniform pressure as the abrasive composite wears during use. Additionally, during manufacture of the abrasive article, this variable surface area results in easier release of the abrasive composite from the production tool. In general there are at least 5 individual abrasive composites per square cm. In some instances, there may be at least 500 individual abrasive composites/square cm.

Method of Making the Abrasive Article

An essential step to make any of the inventive abrasive articles is to prepare the slurry. The slurry is made by combining together by any suitable mixing technique the binder precursor, the grinding aid, the abrasive particles and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles and grinding aid are gradually added into the binder precursor. The amount of air bubbles in the slurry can be minimized by pulling a vacuum during the mixing step. In some instances it is preferred to heat, generally in the range of 30° to 70° C., the slurry to lower the viscosity. It is important the slurry have theological properties that allow the slurry to coat well and in which the abrasive particles and grinding aid do not settle out of the slurry.

Energy Source

After the slurry is coated onto the backing, such as via transfer from a production tool (discussed below), the slurry may be exposed to an energy source to initiate the polymerization of the resin in the binder precursor. Examples of energy sources include thermal energy and radiation energy. The amount of energy depends upon several factors such as the binder precursor chemistry, the dimensions of the abrasive slurry, the amount and type of abrasive particles and the amount and type of the optional additives. For thermal energy, the temperature can range from about 30° to 150° C., generally from 40° to 120° C. The exposure time can range from about 5 minutes to over 24 hours.

Suitable radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. Visible radiation refers to non-particulate radiation having a wavelength within the range of about 400 to about 800 nanometers, preferably in the range of about 400 to about 550 nanometers. It is preferred that 300 to 600 Watt/inch visible lights are used.

After this polymerization process is complete, the binder precursor is converted into a binder and the slurry is converted into an abrasive coating. The resulting abrasive article is generally ready for use. However, in some instances other processes may still be necessary such as humidification or flexing. The abrasive article can be converted into any desired form such as a cone, endless belt, sheet, disc, and the like, before the abrasive article is used.

Production Tool

Regarding the third and fourth aspects of the invention, in some instances it is preferred that the abrasive coating be present as precisely shaped abrasive composites. In order to make this type of abrasive article, a production tool is generally required.

The production tool contains a plurality of cavities. These cavities are essentially the inverse shape of the abrasive composite and are responsible for generating the shape of the abrasive composites. The dimensions of the cavities are selected to provide the desired shape and dimensions of the abrasive composites. If the shape or dimensions of the cavities are not properly fabricated, the resulting production tool will not provide the desired dimensions for the abrasive composites.

The cavities can be present in a dot like pattern with spaces between adjacent cavities or the cavities can butt up against one another. It is preferred that the cavities butt up against one another. Additionally, the shape of the cavities is selected such that the cross-sectional area of the abrasive composite decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as engraving, bobbing, electroforming, diamond turning, and the like. One preferred technique for a metal production tool is diamond turning.

A thermoplastic tool can be replicated off a metal master tool. The master tool will have the inverse pattern desired for the production tool. The master tool can be made in the same manner as the production tool. The master tool is preferably made out of metal, e.g., nickel and is diamond turned. The thermoplastic sheet material can be heated and optionally along with the master tool such that the thermoplastic material is embossed with the master tool pattern by pressing the two together. The thermoplastic can also be extruded or cast onto the master tool and then pressed. The thermoplastic material is cooled to solidify and produce the production tool. Examples of preferred thermoplastic production tool materials include polyester, polycarbonates, polyvinyl chloride, polypropylene, polyethylene and combinations thereof. If a thermoplastic production tool is utilized, then care must be taken not to generate excessive heat that may distort the thermoplastic production tool.

The production tool may also contain a release coating to permit easier release of the abrasive article from the production tool. Examples of such release coatings for metals include hard carbide, nitrides or borides coatings. Examples of release coatings for thermoplastics include silicones and fluorochemicals.

Figure 8:
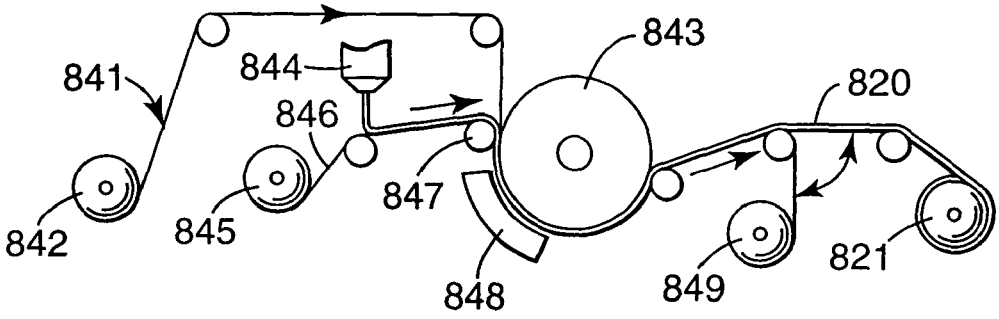
FIG. 8 is an example embodiment of a system for making abrasive articles according to the present disclosure.

One method to make the abrasive article of the invention illustrated in FIG. 1 is illustrated in FIG. 8. Backing 841 leaves an unwind station 842 and at the same time the production tool 846 leaves an unwind station 845. Production tool 846 is coated with slurry by means of coating station 844. It is possible to heat the slurry and/or subject the slurry to ultrasonics prior to coating to lower the viscosity. The coating station can be any conventional coating means such as drop die coater, knife coater, curtain coater, vacuum die coater or a die coater. During coating the formation of air bubbles should be minimized. The preferred coating technique is a vacuum fluid bearing die, such as disclosed in U.S. Pat. Nos. 3,594,865, 4,959,265, and 5,077,870, all incorporated herein by reference. After the production tool is coated, the backing and the slurry are brought into contact by any means such that the slurry wets the front surface of the backing. In FIG. 8, the slurry is brought into contact with the backing by means of contact nip roll 847. Next, contact nip roll 847 also forces the resulting construction against support drum 843. A source of energy 848 (preferably a source of visible light) transmits a sufficient amount of energy into the slurry to at least partially cure the binder precursor. The term partial cure is meant that to binder precursor is polymerized to such a state that the slurry does not flow from an inverted test tube. The binder precursor can be fully cured once it is removed from the production tool by any energy source. Following this, the production tool is rewound on mandrel 849 so that the production tool can be reused again. Optionally, the production tool may be removed from the binder precursor prior to any curing of the precursor at all. After removal, the precursor may be cured, and the production tool may be rewound on mandrel 849 for reuse. Additionally, abrasive article 820 is wound on mandrel 821. If the binder precursor is not fully cured, the binder precursor can then be fully cured by either time and/or exposure to an energy source. Additional steps to make abrasive articles according to this first method are further described in U.S. Pat. No. 5,152,917 and U.S. Ser. No. 08/004,929, filed Jan. 14, 1993, both incorporated herein by reference. Randomly shaped abrasives composites may be made by the tooling and procedures described in U.S. Pat. No. 6,076,248, described above.

It is preferred that the binder precursor is cured by radiation energy. The radiation energy can be transmitted through the production tool so long as the production tool does not appreciably absorb the radiation energy. Additionally, the radiation energy source should not appreciably degrade the production tool. It is preferred to use a thermoplastic production tool and ultraviolet or visible light.

The slurry can be coated onto the backing and not into the cavities of the production tool. The slurry coated backing is then brought into contact with the production tool such that the slurry flows into the cavities of the production tool. The remaining steps to make the abrasive article are the same as detailed above.

Figure 9:
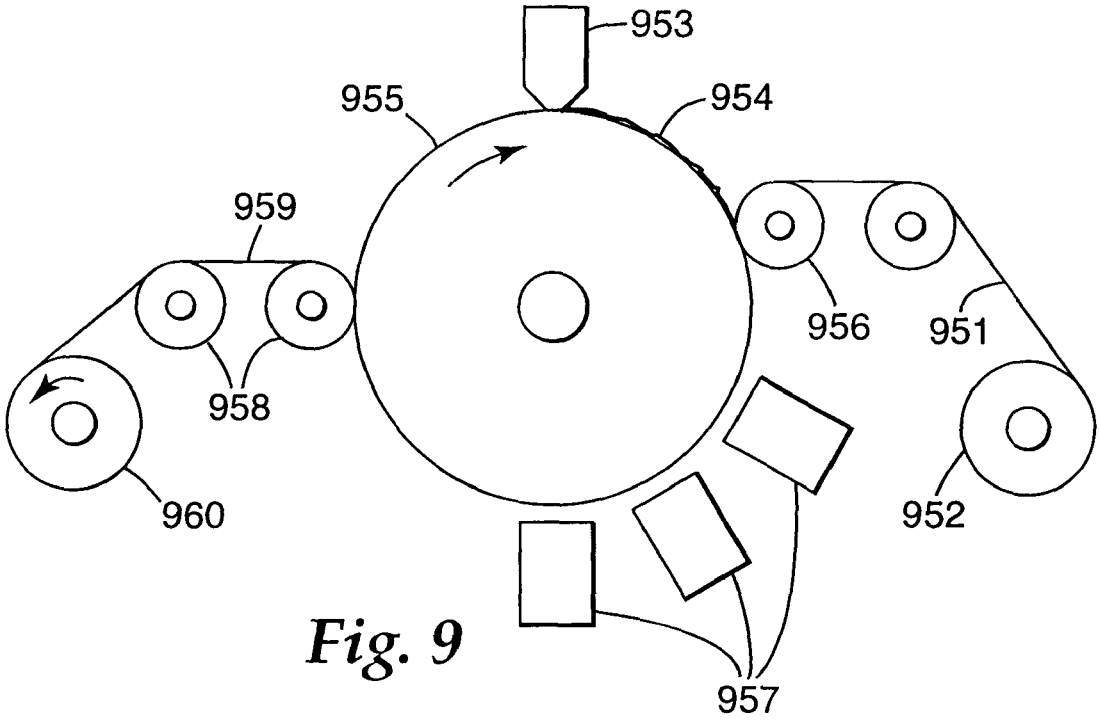
FIG. 9 is another example embodiment of a system for making abrasive articles according to the present disclosure.

Another method is illustrated in FIG. 9. Backing 951 leaves an unwind station 952 and the slurry 954 is coated into the cavities of the production tool 955 by means of the coating station 953. The slurry can be coated onto the tool by any one of many techniques such as drop die coating, roll coating, knife coating, curtain coating, vacuum die coating, or die coating. Again, it is possible to heat the slurry and/or subject the slurry to ultrasonics prior to coating to lower the viscosity. During coating the formation of air bubbles should be minimized. Then, the backing and the production tool containing the abrasive slurry are brought into contact by a nip roll 956 such that the slurry wets the front surface of the backing. Next, the binder precursor in the slurry is at least partially cured by exposure to an energy source 957. After this at least partial cure, the slurry is converted to an abrasive composite 959 that is bonded or adhered to the backing. The resulting abrasive article is removed from the production tool by means of nip rolls 958 and wound onto a rewind station 960. Optionally, the production tool may be removed from the binder precursor prior to any curing of the precursor at all. After removal of the production tool, the precursor may be cured. In either event, the energy source can be thermal energy or radiation energy. If the energy source is either ultraviolet light or visible light, it is preferred that the backing be transparent to ultraviolet or visible light. An example of such a backing is polyester backing.

The slurry can be coated directly onto the front surface of the backing. The slurry coated backing is then brought into contact with the production tool such that the slurry wets into the cavities of the production tool. The remaining steps to make the abrasive article are the same as detailed above.

Method of Refining a Workpiece Surface

Another aspect of this invention pertains to a method of abrading a surface or metal or other material. This method involves bringing into frictional contact the abrasive article of this invention with a workpiece having a metal surface. The term "abrading" means that a portion of the metal workpiece is cut or removed by the abrasive article. Additionally, the surface finish associated with the workpiece surface is typically reduced after this refining process. One typical surface finish measurement is Ra; Ra is the arithmetic surface finish generally measured in microinches or micrometers. The surface finish can be measured by a profilometer, such as a Perthometer or Surtronic.

Workpiece

The metal workpiece can be any type of metal such as mild steel, stainless steel, titanium, metal alloys, exotic metal alloys and the like. The workpiece may be flat or may have a shape or contour associated with it.

Depending upon the application, the force at the abrading interface can range from about 0.1 kg to over 1000 kg. Generally this range is from 1 kg to 500 kg of force at the abrading interface. Also depending upon the application, there may be a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like. The abrasive article may oscillate at the abrading interface during use. In some instances, this oscillation may result in a finer surface on the workpiece being abraded.

The abrasive articles of the invention can be used by hand or used in combination with a machine. At least one or both of the abrasive article and the workpiece is moved relative to the other during grinding. The abrasive article can be converted into a belt, tape roll, disc, sheet, and the like. For belt applications, the two free ends of an abrasive sheet are joined together and a splice is formed. It is also within the scope of this invention to use a spliceless belt like that described in the assignee's co-pending patent application U.S. Ser. No. 07/919,541, filed Jul. 24, 1992, incorporated herein after by reference. Generally the endless abrasive belt traverses over at least one idler roll and a platen or contact wheel. The hardness of the platen or contact wheel is adjusted to obtain the desired rate of cut and workpiece surface finish. The abrasive belt speed depends upon the desired cut rate and surface finish. The belt dimensions can range from about 5 mm to 1,000 mm wide and from about 5 mm to 10,000 mm long. Abrasive tapes are continuous lengths of the abrasive article. They can range in width from about 1 mm to 1,000 mm, generally between 5 mm to 250 mm. The abrasive tapes are usually unwound, traverse over a support pad that forces the tape against the workpiece and then rewound. The abrasive tapes can be continuously feed through the abrading interface and can be indexed. The abrasive disc can range from about 50 mm to 1,000 mm in diameter. Typically abrasive discs are secured to a back-up pad by an attachment means. These abrasive discs can rotate between 100 to 20,000 revolutions per minute, typically between 1,000 to 15,000 revolutions per minute.

Geometries

Figure 1B:
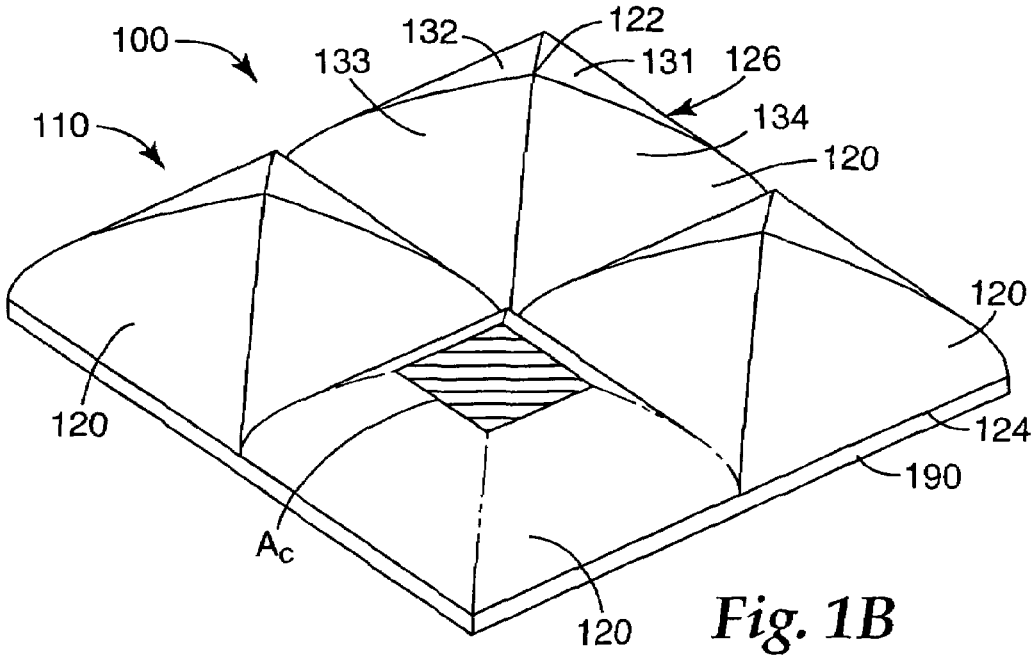
FIG. 1B is another view of the article of FIG. 1.

Referring to FIGS. 1-1B, a portion of an example embodiment of an abrasive article 120 is illustrated. The abrasive article 120 includes a backing 190. The backing 190 is typically a belt, though other shapes and forms are possible. When the backing 190 is a belt, it typically includes a machine direction and a cross direction, which are arranged orthogonally to one another.

The backing 190 connected to an array 110 of microreplicated features 120. Typically, the features 120 are arranged on the backing 120 in an array 110. The array 110 is typically oriented on an angle or bias with respect to the machine direction of the article 100.

The array 110 includes a plurality of features 120. In the example embodiment shown, each feature includes a base 124 and a body 126. Base 124 is preferably a parallelogram, by can be in other shapes as the particular applications requires. Base 124 is adjacent or neighboring the backing 190. In the example embodiment shown, each feature 120 includes a body 126 defined by four sidewalls 131, 132, 133, 134 or surfaces projecting from the base, forming a polyhedron. While the example features shown include four sidewalls, there can be more or less, depending on the particular application. The polyhedron can be of any shape, but is typically pyramidal or prismatic in shape.

Each feature 126 includes at least one sidewall 124 that is defined by a parabolic section extending from the base 124. For a feature 126 having four sidewalls, it is preferred that each sidewall is defined by a parabolic function, as will be described in detail hereinafter. In the example embodiment shown, the four surfaces 131, 132, 133, 134 intersect at a common vertex 122, which forms a cutting point or tooth.

Referring to FIG. 1B, a feature 120 having its top section removed is illustrated. The cross-sectional area Ac of a plane parallel to the base varies proportionally with the height of the cutting plane as measured from the base. This linear variation of cross-sectional area Ac of the feature allows for a flatter cut rate compared to a feature having straight sidewalls, as measured over the life of the abrasive article.

Figure 2:
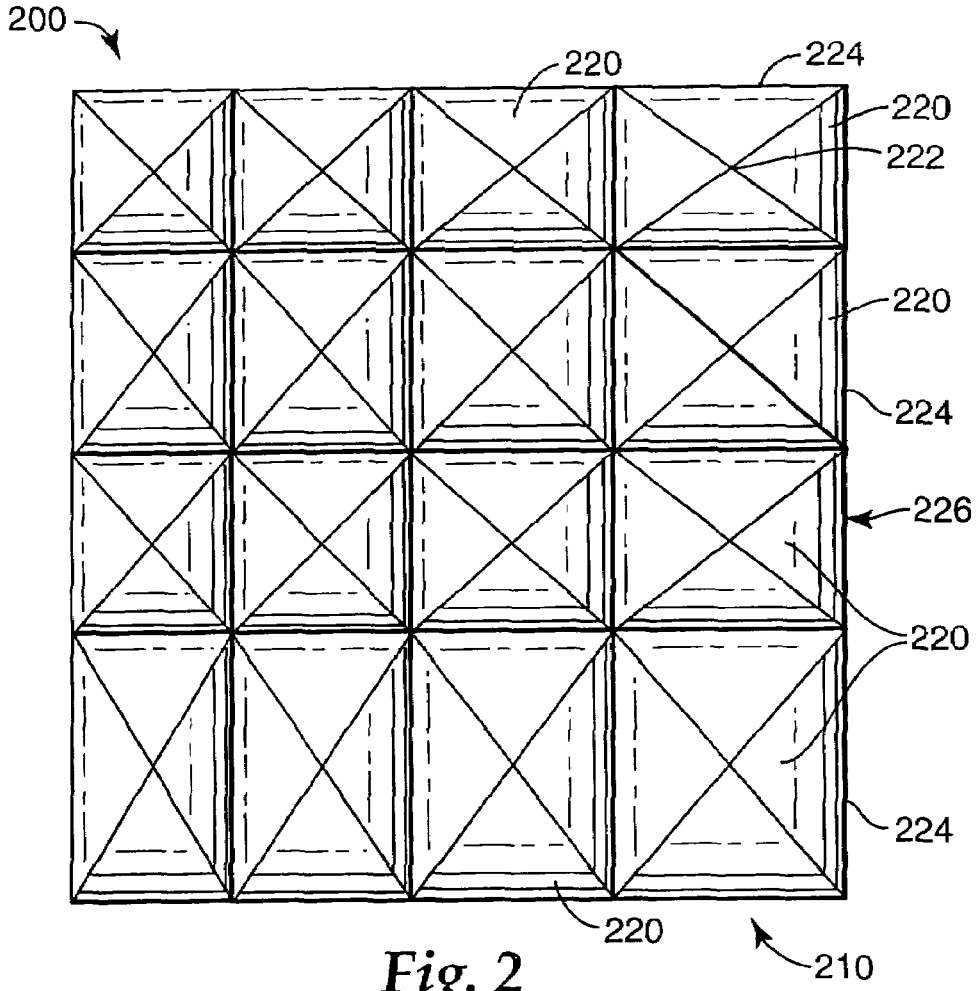
FIG. 2 is an example embodiment of an array of features according to the present disclosure.

Referring to FIG. 2, an abrasive article 200 having a plurality of features 220 is illustrated. The features 220 form an array 210 on the article 200. Typically, each individual feature 220 has a base 224 and a body 226 with the same vertex 222 height, which is some embodiments is between about 20 and 40 mils. In the example embodiment shown, some features 220 have different base 224 sizes. The base sizes of each feature in the array can be the same or different, and the particular combination of feature sizes will depend on the particular application. Selection of such characteristics is within the ordinary skill in the art.

Figure 4:
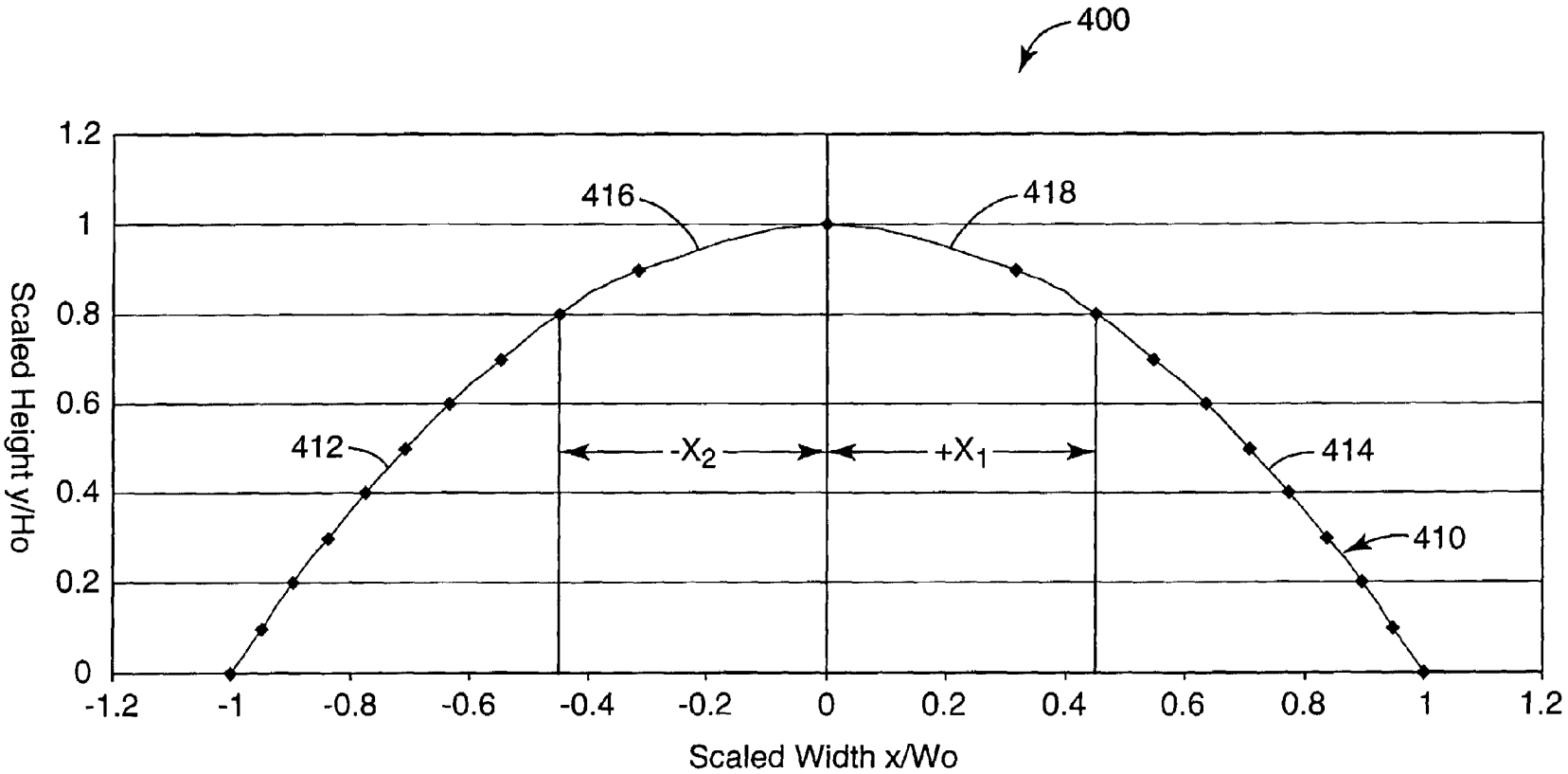
FIG. 4 is a graph illustrating a example embodiment of a profile for a feature for an abrasive article according to the present disclosure.

Referring to FIG. 4, a graph illustrating a parabolic profile for a sidewall is illustrated. The graph shown is scaled for a feature having a vertex height (measured as the point most distally located from the base) of Ho and a base width of Wo. The locus of points defining the parabolic profile is generated by equation 1:

$$(x/Wo)^2=1-(y/Ho) \qquad \text{Equation 1}$$

A feature having sidewalls defined by Equation 1 would be formed by the locus of points defined by two orthogonal profiles juxtaposed on one another. The outer surfaces of the feature would then retain the volume defined between the base and by the intersection of the various sidewall profiles. To illustrate, referring again to FIG. 1, opposed sidewalls 131, 133 would be defined by Equation 1, scaled to the desired height of the vertex. Opposed sidewalls 132, 134 would be defined by the same equation, only the surface defined by sidewalls 132, 134 would be oriented orthogonally to the surface defined by sidewalls 131, 133. The resulting feature would include all the volume included between the intersection of the parabolicly defined sidewalls and the base. In some embodiments, the sidewalls are not functionally smooth (continuous), but are defined by a series of interconnected line segments.

In one embodiment, each feature includes two set of opposed sidewalls oriented orthogonal to one another, wherein each set of opposed sidewalls is defined by a continuous parabolic function, as illustrated in FIG. 4. However, such a feature will have a top with a slope of zero, resulting in a rounded vertex. In other embodiments, a tooth or cutting edge is formed, to get better initial cut with lower pressure. In such a case, the cross-sectional area of the feature (as measured from the base) will vary linearly with height up to about 90 percent of the feature height, as measured from the base.

Figure 5:
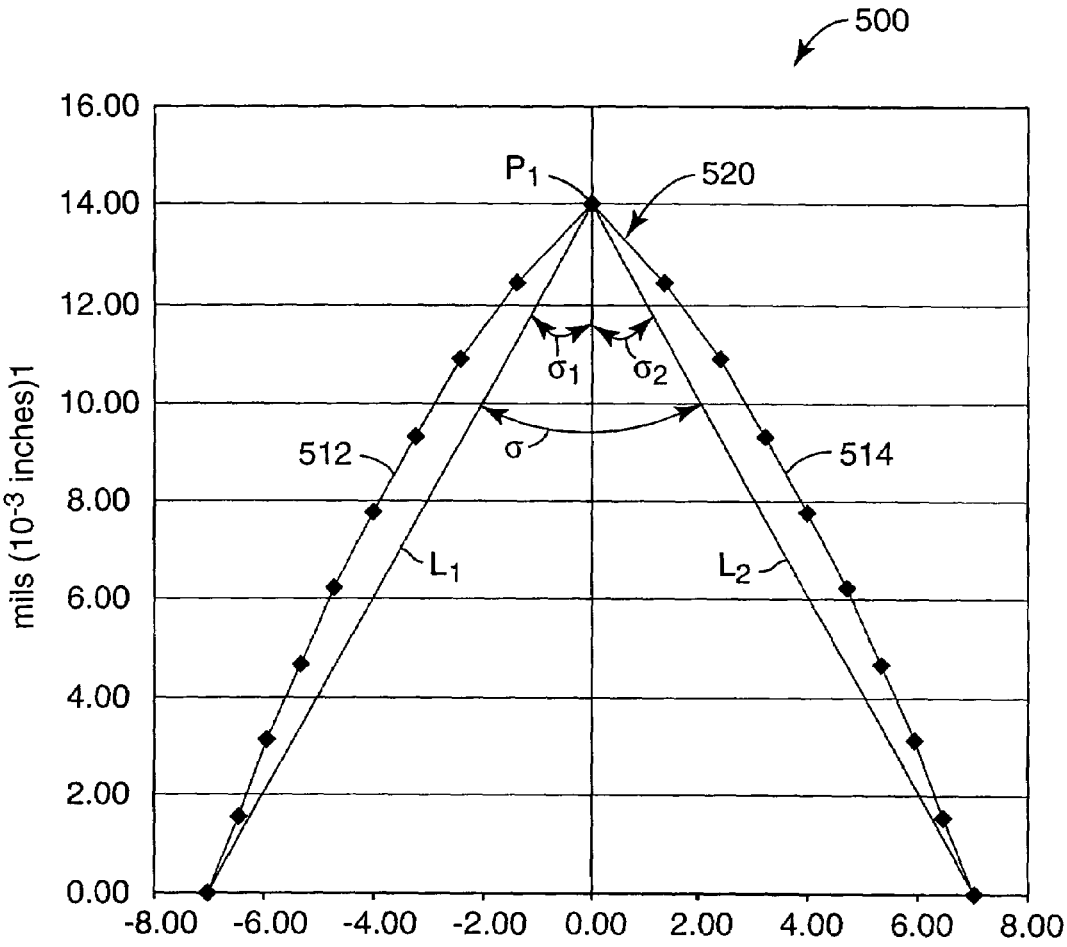
FIG. 5 is a graph illustrating another example embodiment of a profile for a feature for an abrasive article according to the present disclosure.

Such a feature as described in the preceding paragraph can be defined using sidewalls defined by sections having a partial parabolic profile. Referring again to FIG. 4, the locus 410 of points defining the parabolic section can be divided into four sections 412, 414, 416, and 418. Opposed sections 412, 414 could be shifted towards the origin of the graph 400 by X2 and X1 respectively. This would eliminate sections 416, 418 to form a profile for opposed sidewalls defined by a parabolic function while at the same time creating a sharp cutting edge at the vertex of the feature. An example of such a profile is illustrated in graph 500 of FIG. 5. The profile includes opposed parabolic sections 512, 514 to form a profile 520 for opposed sidewalls for a feature having a height of 14 mils (1 mil=0.001 inch). A tooth angle σ is formed in the profile. The tooth angle σ is formed by summing individual tooth angles σ1, σ2 formed by each section 512, 514. In the context of this disclosure, "tooth angle" is defined as the included angle formed between lines connecting the peak of a feature with its outermost base section, as can be seen as illustrated in FIG. 5. Lines L1 and L2 intersect at the peak P1 and each projects to the outmost edge of the base. Each partial tooth angle σ1, σ2 is measured from a perpendicular line extending from the base to the peak P1.

In the example embodiment illustrated, σ1 and σ2 are equal. In some embodiments, the tooth angle σ is between about 60 degrees and 110 degrees, though it can be more or less depending on the particular application.

Figure 6:
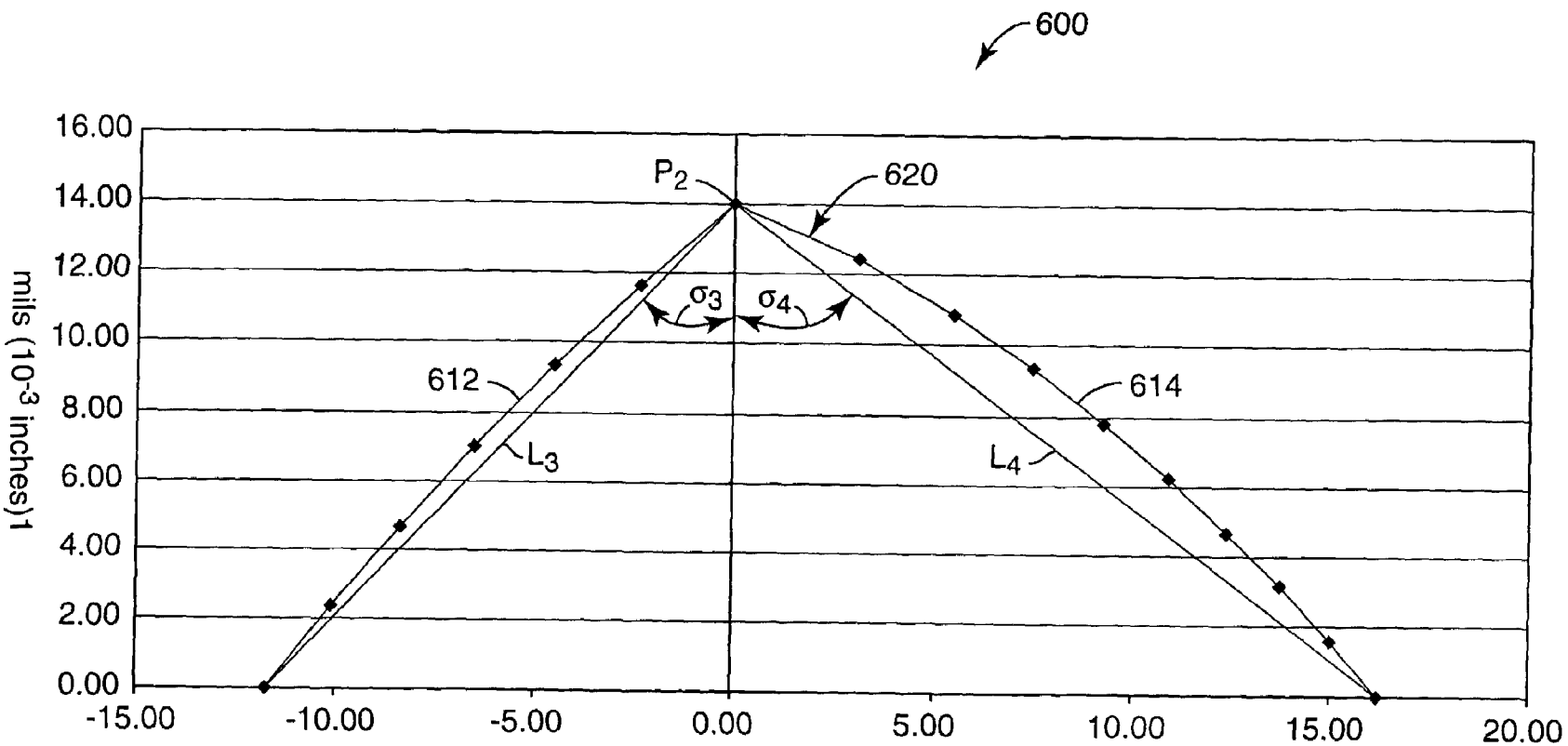
FIG. 6 is a graph illustrating another example embodiment of a profile for a feature for an abrasive article according to the present disclosure.

In other embodiments, it is preferred to have a feature that uses asymmetric profiles to define the body. Referring to graph 600 of FIG. 6, a profile 620 for a feature with a nominal vertex height of 14 mils is shown. Parabolic sections 612, 614 define the profile. Sidewall sections are arranged such that each profile has a different individual tooth angle σ3, σ4. A parabolic locus defines section 614 for a feature that would have a nominal height of 15.6 mils if not truncated, and a nominal width of 23.75 mils. A parabolic locus defines 612 for a feature that would have a nominal height of 23.3 mils if not truncated, and a width of 32 mils. The profile 620 formed by combining section 612, 614 results in a feature having a cutting tooth with a pointed vertex, which increases initial cut when abrading a workpiece with an abrasive article having features as described. Lines L3 and L4 intersect at the peak P2 and each projects to the outmost edue of the base. Each partial tooth angle σ3, σ4 is measured from a perpendicular line extending from the base to the peak P2.

Figure 7:
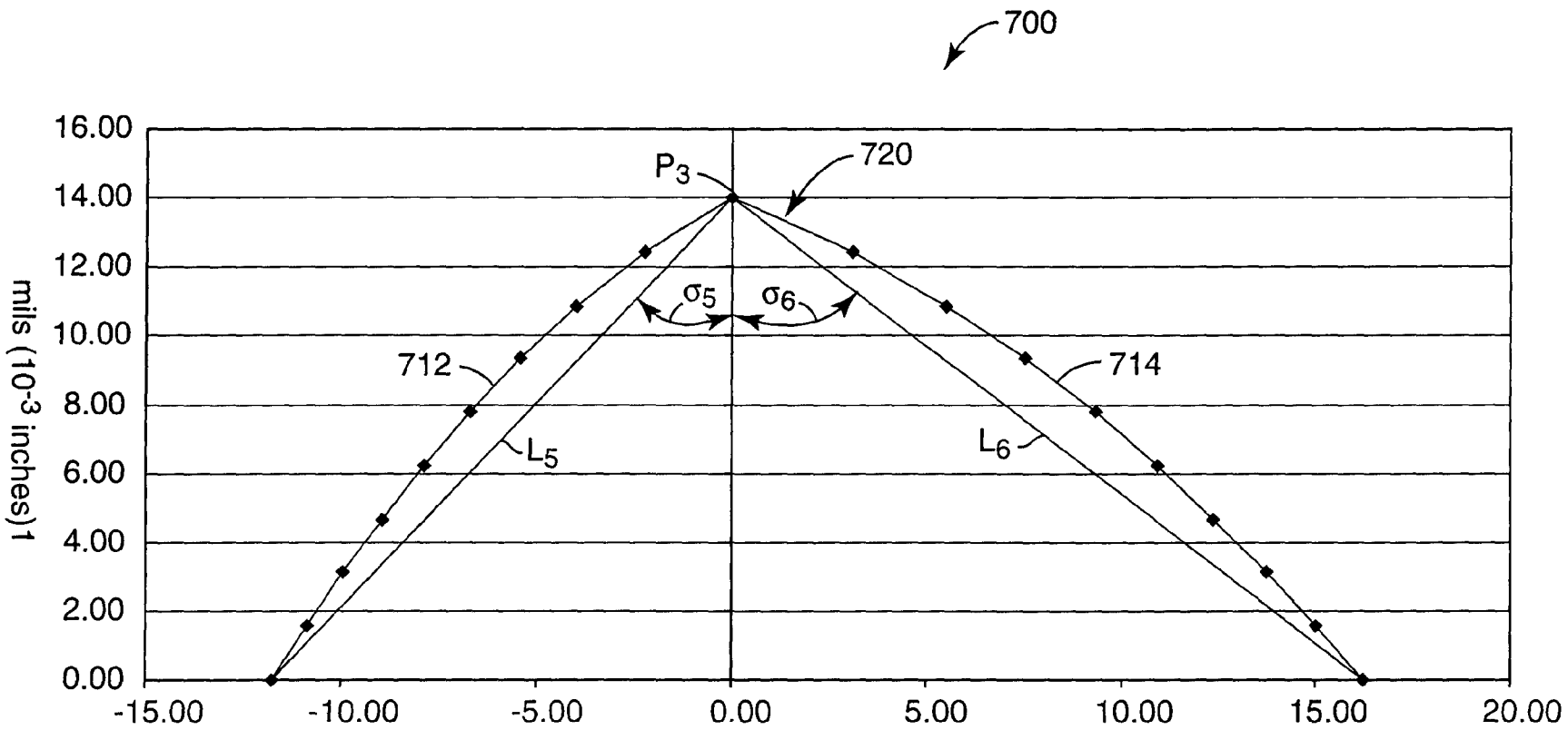
FIG. 7 is a graph illustrating another example embodiment of a profile for a feature for an abrasive article according to the present disclosure.

Another example embodiment of an asymmetrical feature profile 720 is illustrated in graph 700 of FIG. 7. The profile 720 is for a feature with a nominal vertex height of 14 mils. Parabolic sections 712, 714 define the profile. Sidewall sections are arranged such that each profile has a different individual tooth angle σ5, σ6. A parabolic locus defines section 714 for a feature that would have a nominal height of 15.6 mils if not truncated, and a width of 23.75 mils. A parabolic locus defines 712 for a feature that would have a nominal height of 15.5 mils if not truncated, and a width of 23.7 mils. The profile 720 formed by combining section 712, 714 results in a feature having a cutting tooth with a pointed vertex, which increases initial cut when abrading a workpiece with an abrasive article having features as described. Lines L5 and L6 intersect at the peak P3 and each projects to the outmost edue of the base. Each partial tooth angle σ5, σ6 is measured from a perpendicular line extending from the base to the peak P3.

Upon reading this disclosure, one of ordinary skill in the art will appreciate that features having sidewalls defined by the same or different parabolic profiles can be made. Selection will depend on the particular application for each feature to be included in an abrasive article.

EXAMPLE 1

Figure 3:
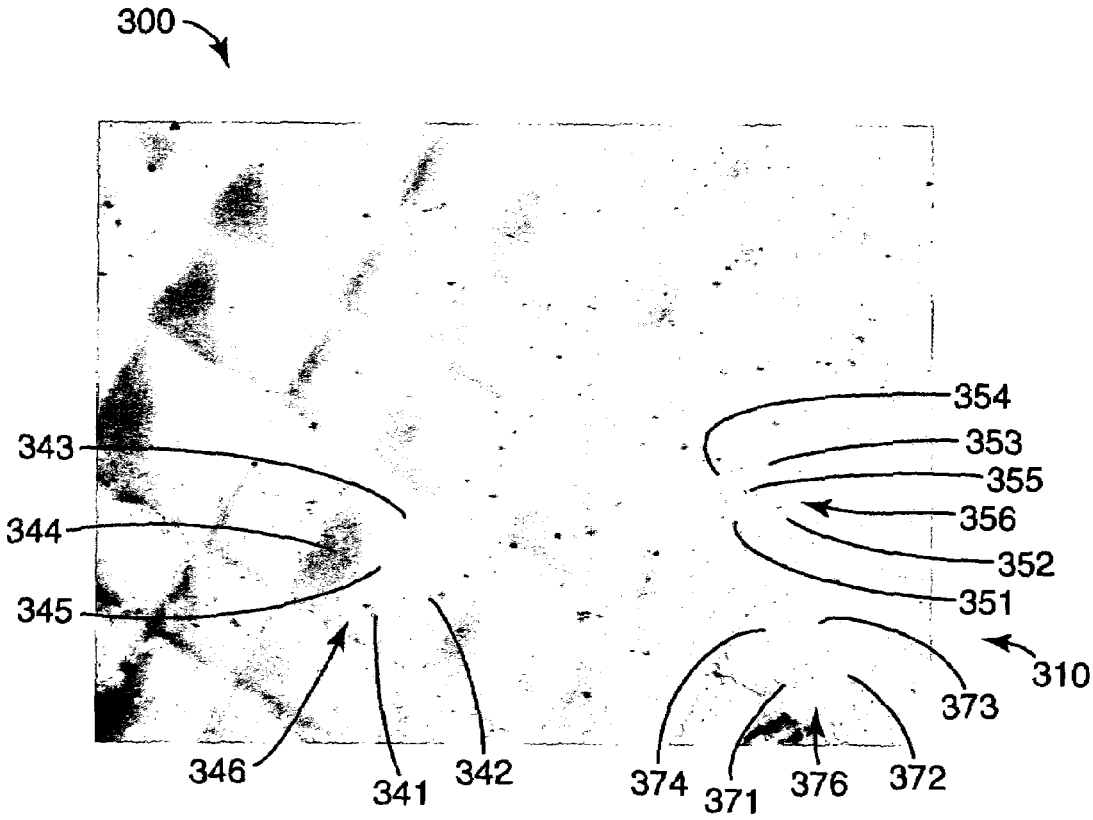
FIG. 3 is a microphotograph of an article according to the present disclosure.

Referring to FIG. 3, an abrasive article 300 according to the present disclosure was made. The article 300 included an array 310 of features 346, 356, 376 arranged on a backing material (not shown). The features were arranged so that the features were offset. Each feature had a height at its vertex most distally located from the backing of about 30 mils (1 mil equals 0.001 inch). Various base sizes were used, including features 356 having a base 20 by 20 miles (such as defined by sidewalls 351, 352, 353, 354 and vertex 355), features 376 having a base 20 by 30 mils (such as defined by sidewalls 371, 372, 373, 374), and features 346 having a base 30 by 30 mils (such as defined by sidewalls 341, 342, 343, 344 and vertex 345). Each feature 346, 356, 376 was included a body defined by parabolic sections.

The abrasive article described-above was made by first creating a tool that was a negative of the image formed by the array. A slurry, made with Tatheic/TMPTA acrylic resin, KBF4, Irgacure 369, OX-50 silica and A174 silane and mineral was then coated onto the backing. The backing and slurry were then brought into contact with the tool. The backing used was polyester/cotton woven backing, available from Milliken. The product was then cured and separated from the tooling. One of ordinary skill in the art will appreciate that many different combinations of abrasive mineral or particles, slurry, backing materials, can be used, depending on the particular application desired for the abrasive article. Also, the abrasive article can be cured off tool.

The above specification, examples and data provide a complete description of the manufacture and use of the invention of the present disclosure. Since many embodiments of the invention can be made without departing from the spirit and scope of the invention, the invention resides in the claims hereinafter appended.

What is claimed is:

1. An abrasive feature for an abrasive article comprising:

a base; and a body projecting from the base, the body comprising abrasive particles, grinding aid and binder and including a vertex, wherein the body is defined by four distinct sidewalls, and further wherein each of the four distinct sidewalls is defined by a parabolic section.

2. The feature of claim 1, wherein the parabolic shape is approximately defined by a series of connected line segments.

3. The feature of claim 1, wherein each of the four distinct sidewalls is formed from the same parabolic section, and further each section is defined by the same locus in a mirror image, including an opposed image and left and right images.

* * * * *

UNITED STATES PATENT AND TRADEMARK OFFICE

CERTIFICATE OF CORRECTION

PATENT NO. : 7,267,700 B2
APPLICATION NO. : 10/668736
DATED : September 11, 2007
INVENTOR(S) : Stanley B. Collins It is certified that error appears in the above-identified patent and that said Letters Patent is hereby corrected as shown below:

Title page
Item [56], References Cited, OTHER PUBLICATIONS, delete “Material” ,” and insert -- Material”, -- therefor.

Column 2
Line 6, after “illustrating” delete “a” and insert -- an -- therefor.
Line 14, after “disclosure;” delete “and”.

Column 3
Line 16, delete “Mohs’” and insert -- Mohs -- therefor.

Column 4
Line 38, delete “Specialities.” and insert -- Specialties. -- therefor.

Column 5
Line 45, after “VB” delete “VIIB,” and insert -- VIB, -- therefor.
Line 62, delete “triacrylimdazoles,” and insert -- triacrylimidazoles, -- therefor.
Line 63, delete “chloroalkytriazines,” and insert -- chloroalkyltriazines, -- therefor.

Column 6
Line 35-36, delete “tetrachloronaphtalene,” and insert -- tetrachloronaphthalene, -- therefor.
Line 52, delete “Moh” and insert -- Mohs -- therefor.

Column 10
Line 43, delete “to” and insert -- the -- therefor.

Column 14
Line 31, delete “edue” and insert -- edge -- therefor.
Line 49, delete “edue” and insert -- edge -- therefor.
Line 67, delete “Miles” and insert -- mils -- therefor.

UNITED STATES PATENT AND TRADEMARK OFFICE

CERTIFICATE OF CORRECTION

PATENT NO. : 7,267,700 B2
APPLICATION NO. : 10/668736
DATED : September 11, 2007
INVENTOR(S) : Stanley B. Collins It is certified that error appears in the above-identified patent and that said Letters Patent is hereby corrected as shown below:

Column 16

Insert the following claims:

-- 4. A method of making an abrasive feature, the method comprising:

filling a tool with a slurry comprising abrasive particles, grinding aid and binder precursor, wherein the tool includes a plurality of negative images for forming features having a base and a body, wherein the body includes a vertex, wherein the body is defined by four distinct sidewalls, and further wherein each of the four distinct sidewalls is defined by a parabolic section;

curing the slurry to form the abrasive feature. --

-- 5. A method of making an abrasive article, the method comprising:

filling a tool with a slurry comprising abrasive particles, grinding aid and binder precursor, wherein the tool includes a plurality of negative images for forming features having a base and a body, wherein the body includes a vertex, wherein the body is defined by four distinct sidewalls, and further wherein each of the four distinct sidewalls is defined by a parabolic section;

applying a backing to the slurry after filing the tool with slurry; and at least partially curing the slurry to form the abrasive article. --

-- 6. The method of claim 5, further including:

removing the article from the tool after the slurry is at least partially cured. --

-- 7. The method of claim 6, wherein at least partially curing the slurry and after removing the article from the tool, fully curing the slurry. --

Signed and Sealed this

Fifteenth Day of April, 2008

JON W. DUDAS
*Director of the United States Patent and Trademark Office*